United States Patent [19]

Beach

[11] Patent Number: 4,666,214

[45] Date of Patent: May 19, 1987

[54] EARTH WORKING TOOL BIT AND BLOCK ASSEMBLY

[75] Inventor: Wayne H. Beach, Roaring Spring, Pa.

[73] Assignee: Kennametal, Inc., Latrobe, Pa.

[21] Appl. No.: 831,090

[22] Filed: Feb. 21, 1985

Related U.S. Application Data

[63] Continuation of Ser. No. 703,458, Feb. 21, 1985, abandoned, which is a continuation of Ser. No. 337,962, Jan. 8, 1982, abandoned.

[51] Int. Cl.[4] ..... E21C 35/18

[52] U.S. Cl. ..... 299/92; 37/142 A; 175/413; 407/47

[58] Field of Search ..... 299/91–93; 175/413; 37/142 R, 142 A; 407/33, 46, 47, 51

[56] References Cited

U.S. PATENT DOCUMENTS

| | | | |
|---|---|---|---|
| 2,247,202 | 6/1941 | Ratkowski | 37/142 R |
| 3,286,378 | 11/1966 | Benetti | 37/142 A |
| 3,466,772 | 9/1969 | Phillips | 299/92 X |
| 3,702,638 | 11/1972 | Takata | 299/91 X |
| 3,737,199 | 6/1973 | Stephenson | 299/89 |
| 3,749,449 | 7/1973 | Krekeler | 175/413 X |
| 3,826,024 | 7/1974 | Peterson | 37/142 A |
| 3,841,709 | 10/1974 | Kniff | 299/91 X |
| 3,879,867 | 4/1975 | Ericson et al. | 299/92 X |
| 4,180,292 | 12/1979 | Persson | 299/92 |
| 4,187,626 | 2/1980 | Greer et al. | 37/142 R X |
| 4,193,638 | 3/1980 | Heckenhauer | 299/89 |
| 4,282,665 | 8/1981 | Fletcher et al. | 37/142 A |
| 4,302,055 | 11/1981 | Persson | 407/46 X |
| 4,316,636 | 2/1982 | Taylor et al. | 299/92 |
| 4,326,592 | 4/1982 | Stephenson | 172/123 |

FOREIGN PATENT DOCUMENTS

| | | |
|---|---|---|
| 14125 | 5/1968 | Australia . |
| 2404751 | 8/1974 | Fed. Rep. of Germany . |
| 2370831 | 6/1978 | France . |
| 662063 | 11/1951 | United Kingdom . |
| 1115835 | 5/1968 | United Kingdom . |
| 1117688 | 6/1968 | United Kingdom . |
| 1161230 | 8/1969 | United Kingdom . |
| 1410814 | 10/1975 | United Kingdom . |
| 2010777B | 7/1979 | United Kingdom . |

*Primary Examiner*—James A. Leppink
*Assistant Examiner*—John F. Letchford
*Attorney, Agent, or Firm*—John J. Prizzi

[57] ABSTRACT

A bit and block assembly for use on an earthworking machine rotor including a bit, a block for receiving the bit, and elastomeric means for retaining the bit in the block. The bit has a first shank portion of irregular cross section and extending from one end of that shank portion is a second shank portion of smaller cross section. The longitudinal axes of the first and second shank portions are parallel. At the opposite end of the first shank portion is a forward working portion having an edge of wear resistant material for contacting the working medium. The block has a longitudinal bore of irregular cross section similar to the first shank portion.

9 Claims, 10 Drawing Figures

20
A
I
R

EARTH WORKING TOOL BIT AND BLOCK ASSEMBLY

This application is a continuation of application Ser. No. 703,458 filed Feb. 21, 1985, now abandoned, which in turn is a continuation of application Ser. No. 337,962 filed Jan. 8, 1982, now abandoned.

FIELD OF THE INVENTION

This invention relates to the field of earthworking tools, and more specifically, to those tools most useful for soil stabilization, as in road building and road maintenance.

BACKGROUND OF THE INVENTION

Earthworking tools are well known and are used for many purposes, one of which is soil stabilization.

In the process of maintaining or building a road, the base must be properly prepared before the top layer of road material, such as asphalt, can be put down. One such method of preparing the base is by the use of a soil stabilizer. The working medium is contacted by soil stabilizer blades or bits, also known as tines, and are attached to the soil stabilizer rotor as shown, for example, in U.S. Pat. No. 3,702,638.

Due to the abrasive nature of the working medium, the blades must be replaced periodically. When the blades have hard wear resistant material tips, the blade tips last longer and, therefore, the blades need to be replaced less frequently. Nevertheless, the blades still need to be replaced periodically when worn.

Replacing the blades requires that the rotor be stopped. As shown in U.S. Pat. No. 3,702,638, replacing of the blades requires the unbolting of each L-shaped blade. As there can be about sixty blades on each rotor, this can take a considerable amount of time—time during which an expensive piece of equipment is out of operation.

It is desirable, therefore, to have a blade that is easily and quickly replaceable.

In the prior earthworking art, replaceable earthworking bits are known. For example, U.S. Pat. No. 3,841,708, assigned to the present assignee, shows a replaceable bit, but one which is also allowed to rotate during the working of the bit.

In U.S. Pat. No. 3,841,709, assigned to the present assignee, the bit is prevented from rotating by a pin through the shank.

A prior art type of soil stabilizer blade is shown in U.S. Pat. No. 3,737,199, also assigned to the present assignee.

A product produced by assignee corporation, the AR-150 bit, shows a shank cross section similar to that shown by applicant in this invention. However, the AR-150 is in many other way dissimilar from the invention disclosed herein.

It is a primary object of this invention to make a bit that is easily and quickly replaceable.

It is also an object of this invention to make a bit that is simple to assemble to its block.

It is a further object of this invention to make a bit that is easy to disassemble from its block.

BRIEF SUMMARY OF THE INVENTION

According to the present invention, there is disclosed a bit and block assembly in which one shank portion of the bit has an irregular cross section to match a similar irregular bore of the block. A second shank portion of the bit extends rearward beyond the block as an aid in disassembling the bit from the block. The first shank portion also has at least one lateral bore through its cross section and at least one longitudinal recess along its outer surface. The shank is retained in the block by inserting a piece of elastomeric material into the lateral bore and wedging the material between the bore of the block and the recess of the shank.

Preferably, the length of the first shank portion is greater than the length of the second shank portion. More preferably, the length of the first shank portion is substantially equal to the length of the longitudinal bore of the block.

While it is preferable that the lateral bore be on the first shank portion, it is within the scope of this invention to have at least one lateral bore on the second shank portion as long as the lateral bore is on some part of the first and second shank portions contained within the bore of the block. There would also be at least one surface recess extending longitudinally from the lateral bore toward the forward working portion.

Due to the abrasive nature of the working medium, the bit will be worn away after a period of time and will need to be replaced. It is anticipated that the bock wi1 normally not be repaced every time a bit is replaced. According to the invention, the bit has a first shank portion of irregular cross section. Extending from one end of the first shank portion is a second shank portion of smaller cross section. The longitudinal axes of the first and second shank portion are parallel but spaced apart. There is a forward working portion extending from the opposite end of the first shank portion and forming an abutment shoulder at the junction of the first shank portion and the forward working portion. The forward working portion is generally flat and bar-like and has an edge of wear resistant material for contacting the working medium.

The first or second shank portion may have at least one lateral bore perpendicular to the longitudinal axes of the first and second shank portions. Extending longitudinally from the lateral bore toward the forward working portion is at least one surface recess.

Preferably, the length of the first shank portion is greater than the length of the second shank portion. More preferably, the irregular cross section of the first shank portion is substantially D-shaped while the cross section of the second shank portion is circular. The D-shaped first shank portion is received in a substantially D-shaped bore in a central portion of the block of the assembly.

The width of the forward working portion gradually increases from a minimum at the abutment shoulder to a maximum near the edge of wear resistant material.

In a preferred embodiment, the top surface of the forward working portion contains two peripheral strengthening ribs. Each rib is substantially in the longitudinal direction and extends from the abutment shoulder and along the edge of the top surface of the forward working portion toward the edge of hard wear resistant material.

In another preferred embodiment, the top surface of the forward working portion contains at least one central strengthening rib. The rib is substantially in the longitudinal direction and extends from the center of the abutment shoulder toward the center of the edge of hard wear resistant material.

In a further preferred embodiment, the top and bottom surfaces of the forward working portion each contain a projection substantially perpendicular to the longitudinal axis of the first shank portion. The projection of the top surface is substantially above the projection of the bottom surface.

BRIEF DESCRIPTION OF THE DRAWINGS

The exact nature of the present invention will become more clearly apparent upon reference to the following detailed description taken in connection with the accompanying drawings in which.

DETAILED DESCRIPTION OF THE INVENTION

Figure 1:
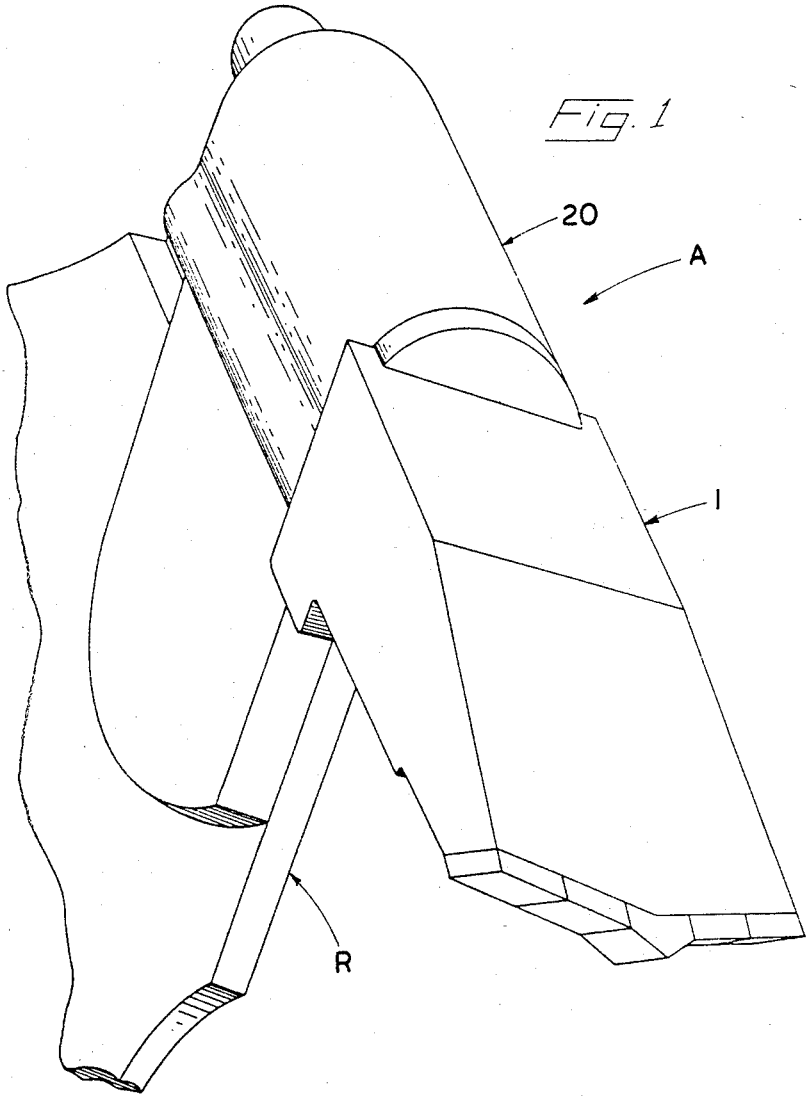
FIG. 1 is a perspective view of a bit and block assembly joined to a rotor.

The bit and block assembly generally designated by the letter A and being comprised of a bit 1 and a block 20, is shown in FIG. 1 as it would normally appear in conjunction with a rotor R (being shown in (fragmentary form) to form a rotor assembly (not shown) for use as a soil stabilizer. The block 20 is adapted to be mounted to the rotor R in a conventional manner.

Figure 2:
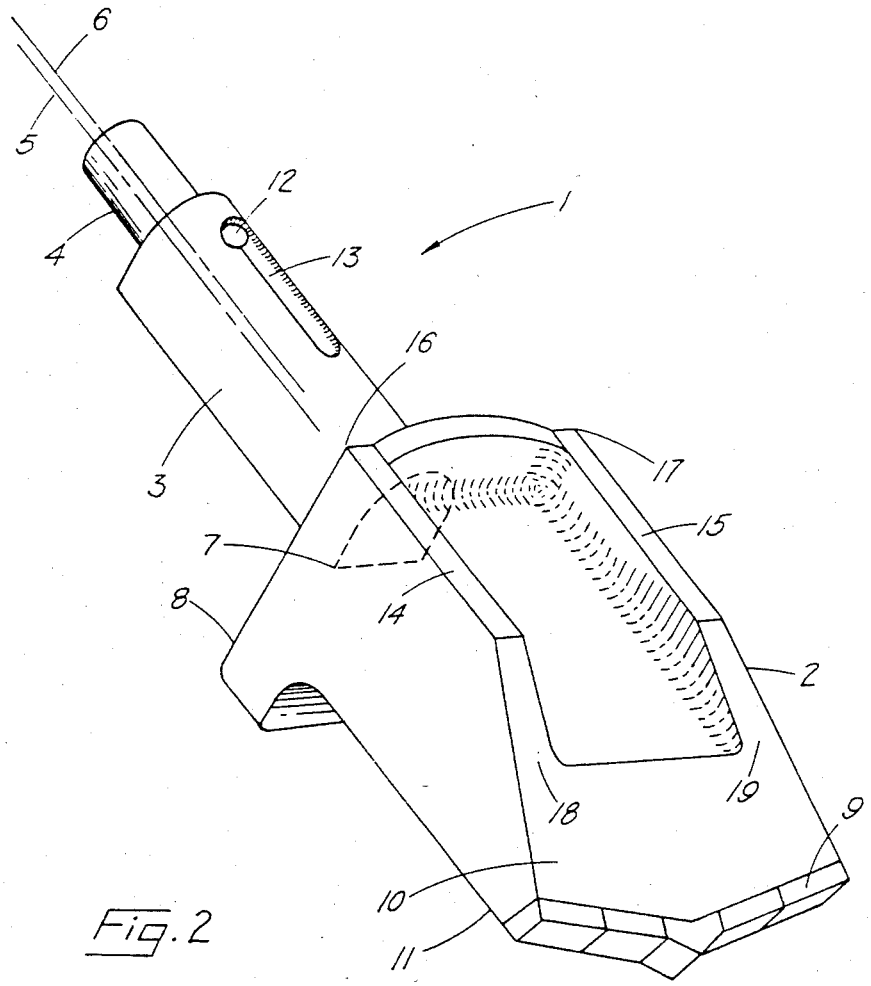
FIG. 2 is a perspective view of the bit.

Referring to the drawings in more detail, the bit, according to the present invention, is shown in FIG. 2. The bit 1 has a forward working portion 2, a first shank portion 3 and a second shank portion 4. The first shank portion has an irregular cross section extending uniformly between its front and rear ends. Joined to the first shank portion, and extending rearwardly, is the second shank portion which is smaller in cross section than the first cross section. The longitudinal axes of the first and second shank portions 5 and 6, respectively, are parallel but spaced apart. Forward of the first shank portion, and joined to it, is the forward working portion. At the junction 7 of the first shank portion and the forward working portion is the abutment shoulder 8. The forward working portion has generally flat top and bottom surfaces 10 and 11, respectively, and is bar-like and has an edge of hard wear resistant material 9 for contacting the working medium.

Figure 3:
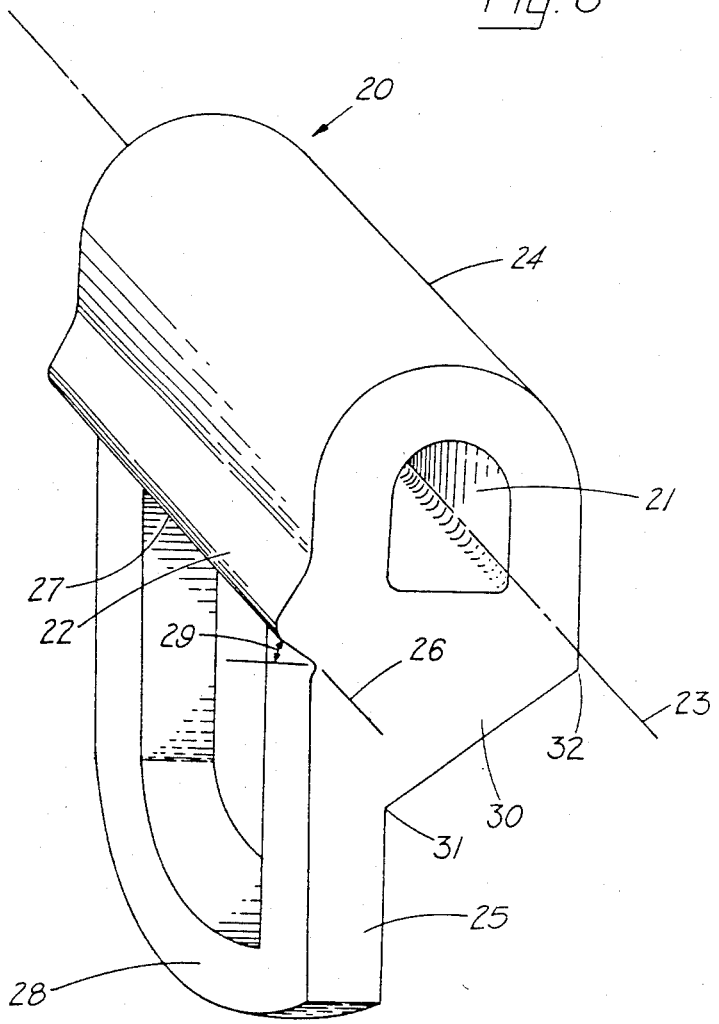
FIG. 3 is a perspective view of the block.

The bit 1 is received by block 20, FIG. 3. The block has an irregular bore 21 similar to the irregular cross section of first shank portion 3 and extending uniformly between opposite ends of the bore. The length of the bore of the block is such that, according to the invention, some part of the second shank portion extends rearwardly of the block.

The bit is retained in the block by elastomeric means, such as a rubber keeper 45. The operation of the elastomeric means is described in further detail below.

Figure 6:
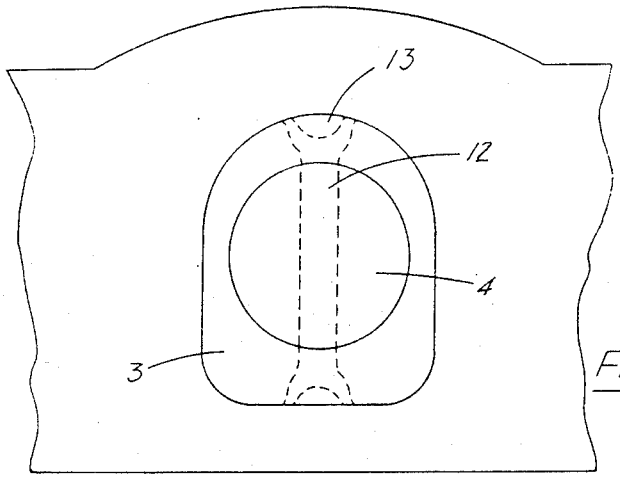
FIG. 6 is a side view of the bit of FIG. 1 looking toward the first and second shank portions.

The first shank portion 3 has at least one lateral bore 12 perpendicular to the longitudinal axis 5 of the first shank portion. The first shank portion also has at least one surface recess 13 extending longitudinally from the lateral bore 12 and toward the forward working portion 2. Of course, the lateral bore 12 may extend entirely through the first shank portion, as shown in FIG. 6, or there may be more than one lateral bore. Similarly, there may be more than one surface recess 13.

Figure 7:
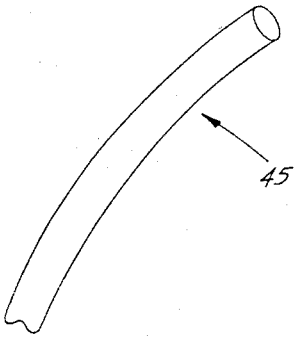
FIG. 7 is a perspective view of the elastomeric means.

Preferably, the lateral bore will be on the first shank portion. More generally, however, according to the invention, there is at least one lateral bore perpendicular to the longitudinal axes of the first and second shank portions on that part of the first and second shank portions contained within the longitudinal bore of the block. The lateral bore, therefore, need not be on the first shank portion. There is also at least one surface recess extending longitudinally from the lateral bore toward the forward working portion As mentioned earlier, the bit is retained in the block by elastomeric means, such as a rubber keeper 45. The elastomeric means is inserted into the lateral bore. Preferably, the lateral bore will be on the first shank portion, but it may also be on the second shank portion, just so long as it is on some part of the first and second shank portions contained within the bore of the block. When the bit is fully received by the block, the elastomeric material will be firmly wedged between the longitudinal bore of the block and the surface recess extending longitudinally from the lateral bore. Necessarily, the bit is sufficiently wedged in the block such that it would not loosen during operation of the rotor. As shown in FIG. 7, the elastomeric means 45 is preferably in the shape of a long cylinder. However, other shapes will retain the bit satisfactorily.

In a preferred embodiment, the length of the first shank portion 3 is greater than the length of the second shank portion 4. More preferably, the length of the first shank portion is substantially equal to the length of the longitudinal bore of the block.

Figure 8:
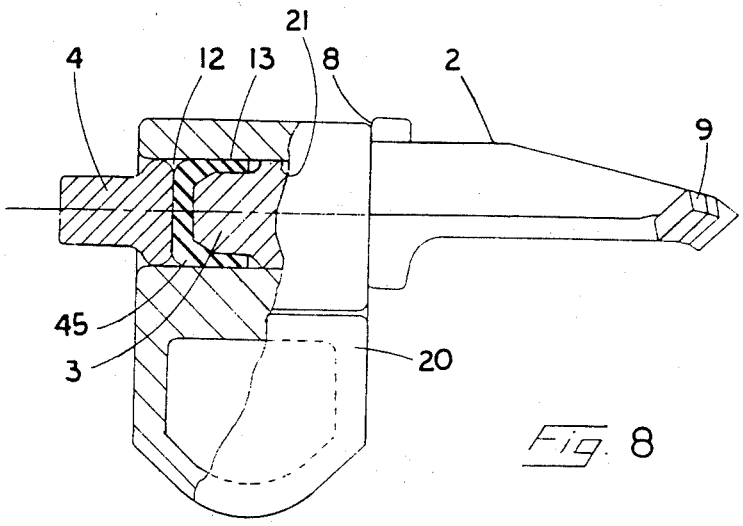
FIG. 8 is a cut away section of a bit and block assembly.

The fully assembled bit and block can best be seen in FIG. 8, being generally designated A. The elastomeric means 45 is inserted in the lateral bore 12 and is wedged between the longitudinal bore 21 of the block 20 and the surface recess 13 of the first shank portion 3. The abutment shoulder 8 of the forward working portion 2 firmly abuts the block. Rearward of the block is second shank portion 4. The length of the first shank portion is substantially equal to the length of the longitudinal bore of the block and is greater than the length of the second shank portion. At the tip of the forward working portion is the hard wear resistant material 9.

In a further preferred embodiment, the width of the working portion gradually increases from a minimum at the abutment shoulder 8 to a maximum near the edge of wear resistant material 9. The top surface of the forward working portion may also contain two peripheral strengthening ribs 14 and 15, each rib being substantially in the longitudinal direction and extending from the abutment shoulder at 16 and 17, respectively, and along the edge of the top surface toward the edge of hard wear resistant material. Each strengthening rib 14 and 15 would not actually extend to the edge of hard wear resistant material but would end before then such as at 18 and 19, respectively.

Figure 4:
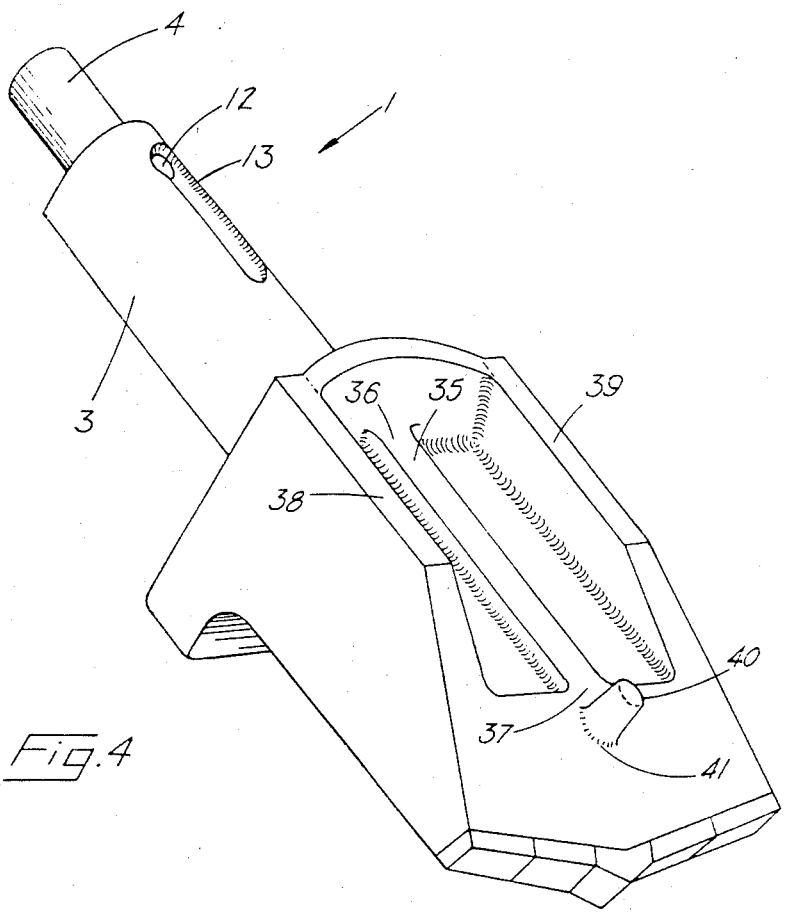
FIG. 4 is a perspective view of a modified bit of FIG. 1.

In another embodiment, FIG. 4, the top surface of the forward working portion contains at least one central strengthening rib 35, the rib being substantially in the longitudinal direction and extending from the center of the abutment shoulder 36 toward the center of the edge of hard wear resistant material and ending at 37. It will be understood that the forward working portion may contain the central strengthening rib 35, by itself, or in conjunction with peripheral strengthening ribs 38 and 39, as shown in FIG. 4.

As also shown in FIG. 4, the top and bottom surfaces of the forward working portion may each contain a projection substantially perpendicular to the longitudinal axis of the first shank portion, the projection of the top surface being substantially above the projection of the bottom surface. Only the projection 40, located at 41 of the top surface of the forward working portion, is shown, it being understood that the projection on the bottom surface of the forward working portion is similarly shaped and similarly located. In the operation of the bit, these projections are of no other use than in assembly and are subsequently worn away.

Figure 5:
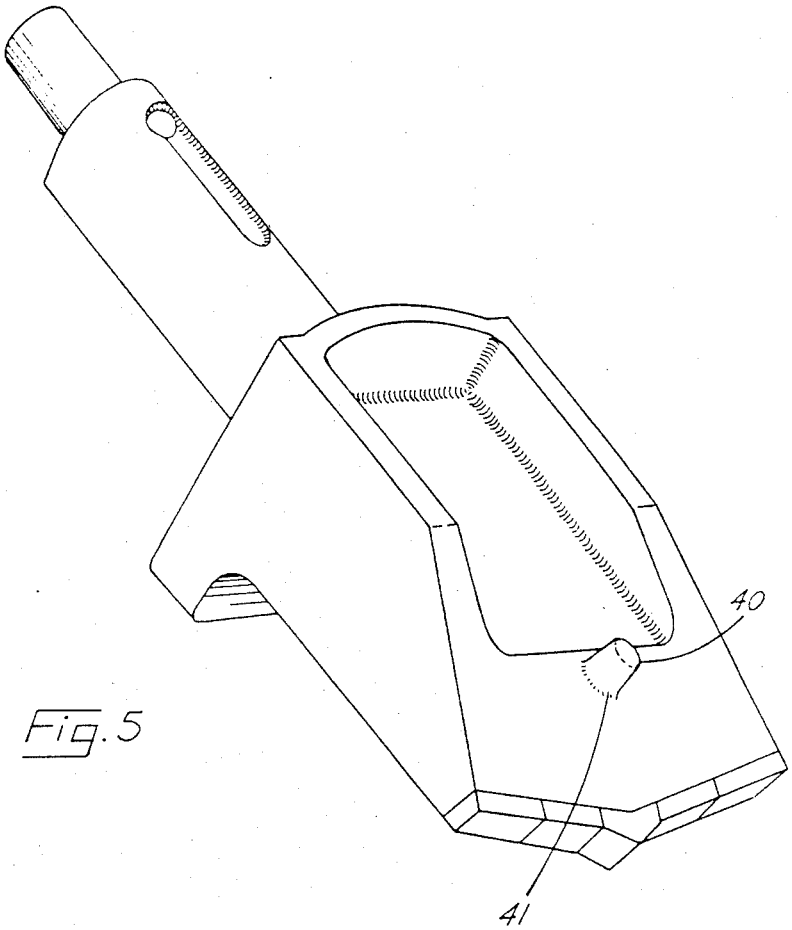
FIG. 5 is a perspective view of a modified bit of FIG. 1.

The embodimient of FIG. 2 is shown in FIG. 5 with the projection 40 located at 41 of the top surface of the forward working portion, it also being understood that the projection on the bottom surface of the forward working portion is similarly shaped and similarly located.

The block 20, as shown in FIG. 3, will now be described in greater detail. Longitudinal bore 21 defined in a central portion 24 of the block 20 has an irregular cross section similar to the irregular cross section of the first shank portion 3 of the bit. Preferably, the longitudinal bore of the block and the cross section of the first shank portion will be D-shaped. This D-shape is best shown in FIG. 6 and can be described as the shape defined by the intersection of a semi-circle and a semi-rectangle. Shown also is the preferred cross section of the second shank portion and can be described as being circular and having a diameter smaller than the diameter of the semi-circle of the first shank portion.

The block may be affixed at its flange portion 25 to the rotor R as by welding. When the bit and block are fully assembled, the longitudinal axis 23 of the bore 24 of the block 20 will be colinear with the longitudinal axis 5 of the first shank portion 3 and both axes will be parallel to, but spaced from, the axis 6 of the second shank portion 4.

Figure 9:
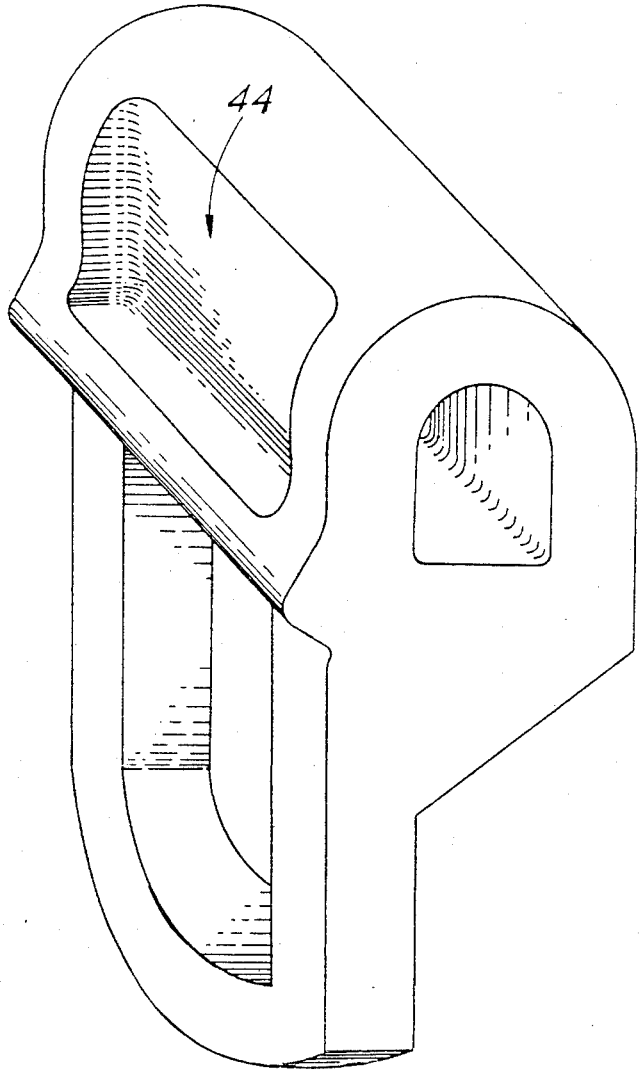
FIG. 9 is a perspective view of a modified block of FIG. 2.

The block of FIG. 3 is also shown in FIG. 9, except now the central portion has at least one longitudinally extending surface recess 44.

Figure 10:
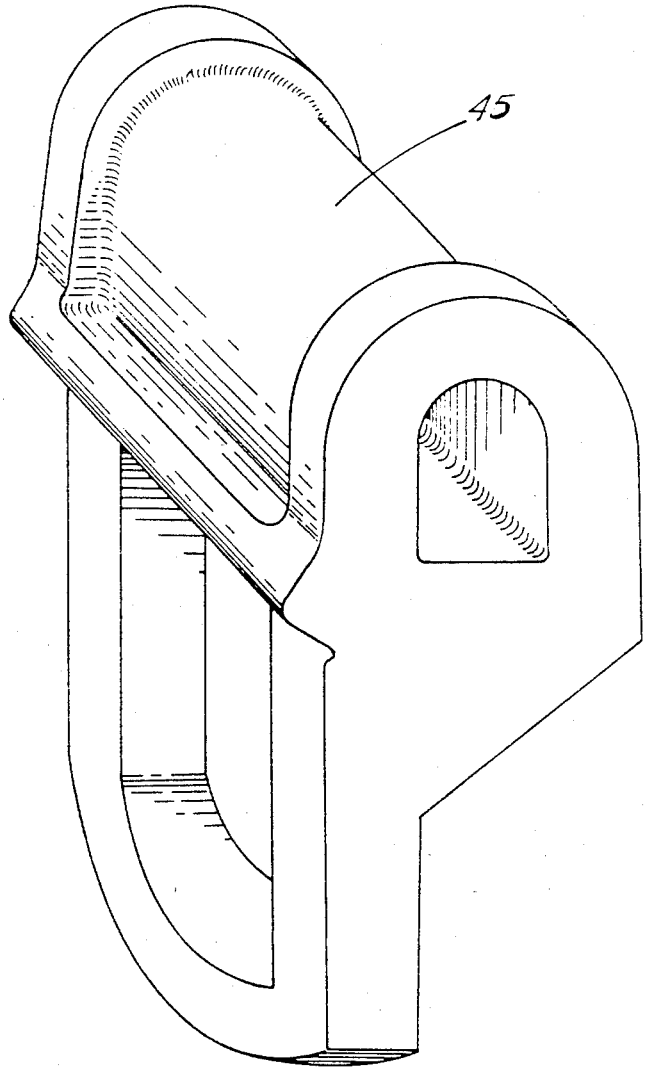
FIG. 10 is a perspective view of another modified block of FIG. 2.

A further modification of the block of FIG. 3 is also shown in FIG. 10, except now the longitudinally extending surface recess 45 may also extend laterally and completely around the top of the central portion of the block.

Modifications may be made within the scope of the appended claims.

What is claimed is:

1. An earthworking tool bit and block assembly, comprising:

(a) a bit having (i) a first shank portion with a longitudinal axis and an irregular cross section extending uniformly between front and rear ends thereof, said first shank portion having a lateral bore defined thereacross proximate the rear end and perpendicular to the longitudinal axis thereof, and at least one surface recess extending longitudinally and forwardly from said lateral bore toward the forward working portion, (ii) a second shank portion with a longitudinal axis and being smaller in cross section than said first shank portion, said second shank portion extending rearwardly from said rear end of said first shank portion, the longitudinal axes of said first and second shank portions being parallel, and (iii) a forward working portion joining the front end of the first shank portion and forming an abutment shoulder at the juncture of said first shank portion and said forward working portion, said forward working portion being flat and bar-like and having an edge of wear resistant material extending substantially across its width for contacting a working medium;

(b) a block receiving said bit and having a longitudinal bore of irregular cross section similar to that of said first shank portion of said bit, said irregular cross section of said bore extending uniformly between opposite ends of the block, at least a substantial portion of said second shank portion extending rearwardly of said longitudinal bore and said block; and (c) an elongated member formed of elastomeric material retaining said bit in said block by having a section of said elongated member inserted through said lateral bore of said bit and an end portion of said elongated member wedged within the longitudinal bore and the surface recess correspondingly between said block and said first shank portion of said bit.

2. A bit and block assembly as in claim 1 wherein the length of the first shank portion is greater than the length of the second shank portion.

3. A bit and block assembly as in claim 2 wherein the length of the first shank portion is substantially equal to the length of the longitudinal bore of the block.

4. A bit and block assembly as in claim 3 wherein the irregular cross sections of the first shank portion and the longitudinal bore of the block are substantially D-shaped.

5. A bit and block assembly as in claim 4 wherein the cross section of the second shank portion is circular.

6. A bit and block assembly as in claim 1 wherein the width of the forward working portion gradually increases from a minimum at the abutment shoulder to a maximum near the edge of wear resistant material.

7. A bit and block assembly 6 as in claim 6 wherein the top surface of the forward working portion contains two peripheral strengthening ribs, each rib being substantially in the longitudinal direction and extending from the abutment shoulder and along the edge of the top surface toward the edge of hard wear resistant material.

8. A bit and block assembly as in claim 6 wherein the top surface of the forward working portion contains at least one central strengthening rib, the rib being substantially in the longitudinal direction and extending from the center of the abutment shoulder toward the center of the edge of hard wear resistant material.

9. A bit and block assembly as in claim 1 wherein the top and bottom surfaces of the forward working portion each contain a projection substantially perpendicular to the longitudinal axis of the first shank portion, the projection of the top surface being substantially above the projection of the bottom surface.

* * * * *